US007790971B1

(12) United States Patent
Roman

(10) Patent No.: US 7,790,971 B1
(45) Date of Patent: Sep. 7, 2010

(54) STRING-REPLACEMENT ASSEMBLY FOR MUSICAL INSTRUMENTS

(75) Inventor: Michael Roman, Levittown, PA (US)

(73) Assignee: Wom Bom, LLC, Huntington Valley, PA (US)

( * ) Notice: Subject to any disclaimer, the term of this patent is extended or adjusted under 35 U.S.C. 154(b) by 0 days.

(21) Appl. No.: 12/493,648

(22) Filed: Jun. 29, 2009

(51) Int. Cl.
*G10D 3/00* (2006.01)

(52) U.S. Cl. ..... 84/297 R

(58) Field of Classification Search ..... 84/297 S, 84/290, 291, 303, 307, 312 R
See application file for complete search history.

(56) References Cited

FOREIGN PATENT DOCUMENTS

JP 05323954 A * 12/1993

* cited by examiner

*Primary Examiner*—Kimberly R Lockett
(74) *Attorney, Agent, or Firm*—Montgomery, McCracken, Walker & Rhoads, LLP; Robert R. Axenfeld

(57) ABSTRACT

A string-replacement assembly may be installed within an inner cavity of a body of a guitar. The assembly includes a plurality of cartridges each configured to contain a supply of replacement string therein, corresponding to a particular gauge of string for the guitar. Each supply of replacement string is rotatably mounted within a cartridge. A free end of each supply of the replacement string can be threaded through an exit opening in the body of the guitar for installation on a topside of the guitar. When string breaks or needs to be replaced on the topside of the guitar, a portion of the supply of the replacement string may be readily advanced from a corresponding cartridge to a desired length, and installed in a playing position on the topside of the guitar, to replace a removed portion (associated with the breakage or replacement) of the string.

19 Claims, 3 Drawing Sheets

STRING-REPLACEMENT ASSEMBLY FOR MUSICAL INSTRUMENTS

TECHNICAL FIELD

This invention is directed to musical-string instruments, and more particularly to electric guitars.

BACKGROUND

Strings on string instruments, such as guitars, eventually break or need to be replaced. The process of replacing a string is time consuming, and inconvenient. Further, a musician must always be vigilant and mindful to keep a sufficient supply of spare sets of each gauge of string in close proximity, such as in an instrument case. If the musician forgets to purchase a certain sized string, or breaks the same string in short succession, it is probable that the musician will exhaust his supply of spare strings needed to replace the broken string. The possibility of exhausting a supply of spare strings is especially problematic in a live-concert setting.

To ensure an ample supply of spare strings is on hand at all times, a musician is usually obliged to port around a sufficient supply of spare strings, which is cumbersome. For instance, if a guitar has six strings, a musician may find it advantageous to carry around at least a dozen spare strings—two spare strings per string. In many instances, each string is sold separately. To avoid kinking the strings, the strings are usually packaged without folds. So, having to keep on hand and port around dozens of separate strings of different sizes at all times is often cumbersome.

SUMMARY

To address the above-discussed deficiencies of the prior art, this invention, provides a string-replacement assembly for musical instruments, such as guitars and related instruments.

In one embodiment, the string-replacement assembly is located within an inner cavity of a body of a guitar. The assembly includes a plurality of cartridges each configured to contain a supply of replacement string therein, which corresponds to a particular gauge of string for the guitar. Each supply of replacement string is rotatably mounted within each cartridge. A free end of each supply of the replacement string can be threaded through an exit opening in the body of the guitar for installation on the topside of the guitar in a playing position. When a string mounted on the topside of the guitar is broken or requires replacement, a desired portion (e.g., a desired length) of the string may be removed, such as by cutting it. A remaining portion of the supply of the replacement string may be readily advanced from a corresponding cartridge to a desired length, and installed on the topside of the guitar to replace the removed portion of the string.

In one embodiment, a locking device, located on the topside of the body of the guitar or within an inner cavity of a body of a guitar, is configured to selectively prevent the replacement string from advancing or moving backwards, once a portion of the string is installed on the topside of the guitar in a playing position. When it is desired to advance the replacement string, the string may be disengaged from the locking device to permit the string to advance out of a cartridge. Alternatively, the locking device itself may be configured to permit the string to readily pass through the locking device, when in an unlocked mode, so as to readily advance the replacement string from the inner cavity of the body of the guitar to a suitable position for installation on the topside of the guitar in a playing position.

In one embodiment, each cartridge contains a complementary pair of opposing spools each with individual axles configured to freely rotate. Each complementary pair of opposing spools is also configured to have at least one replacement string (or several-full lengths of replacement string) wound thereon for eventual installation on the guitar, in the event a string mounted in a playing position on the guitar is broken, or requires replacement. The assembly includes a means for fastening each cartridge within an inner cavity of the guitar.

In one embodiment, each of the complementary pairs of opposing spools is removably coupled to a housing comprising the assembly. This feature permits a roll of replacement string to be installed in the instrument, when exhausted from a spool. In one embodiment, each cartridge may be connected and disconnected from the assembly independently of the other cartridges.

The foregoing outlines embodiments of the invention so that those skilled in the relevant art may better understand the detailed description that follows. Additional embodiments and details will be described hereinafter. Those skilled in the relevant art should appreciate that they can readily use any of these disclosed embodiments as a basis for designing or modifying other structures or functions for carrying out the invention, without departing from the spirit and scope of the invention.

BRIEF DESCRIPTION OF THE DRAWINGS

The detailed description is explained with reference to the accompanying figures. In the figures, the left-most digit(s) of a reference number identifies the figure in which the reference number first appears. The figures are not drawn to scale.

DETAILED DESCRIPTION

As used herein, the term "guitar" refers to a class of fretted-string instruments that may include acoustic or electric guitars, banjos, electric fiddles, or other related-string instruments.

The term "axle" or "shaft" is used interchangeability and refer to a central member around which a spool, or similar device rotates. Alternatively, the central member, itself, may rotate permitting with the spool or similar device attached thereto to rotate with axle or shaft.

The term "playing position" refers to a string being anchored in place on a topside of a guitar, usually between a bridge and headstock of a guitar, and is in condition for playing by a musician.

The term "topside" refers to a front (string side) of the guitar.

Reference herein to "one embodiment", "an embodiment", or similar formulations herein, means that a particular feature, structure, operation, or characteristic described in connection with the embodiment, is included in at least one embodiment of the present invention. Thus, different appearances of such phrases or formulations herein do not necessarily refer to the same embodiment. Furthermore, various particular features, structures, operations, or characteristics may be combined in any suitable manner in one or more embodiments.

Figure 1:
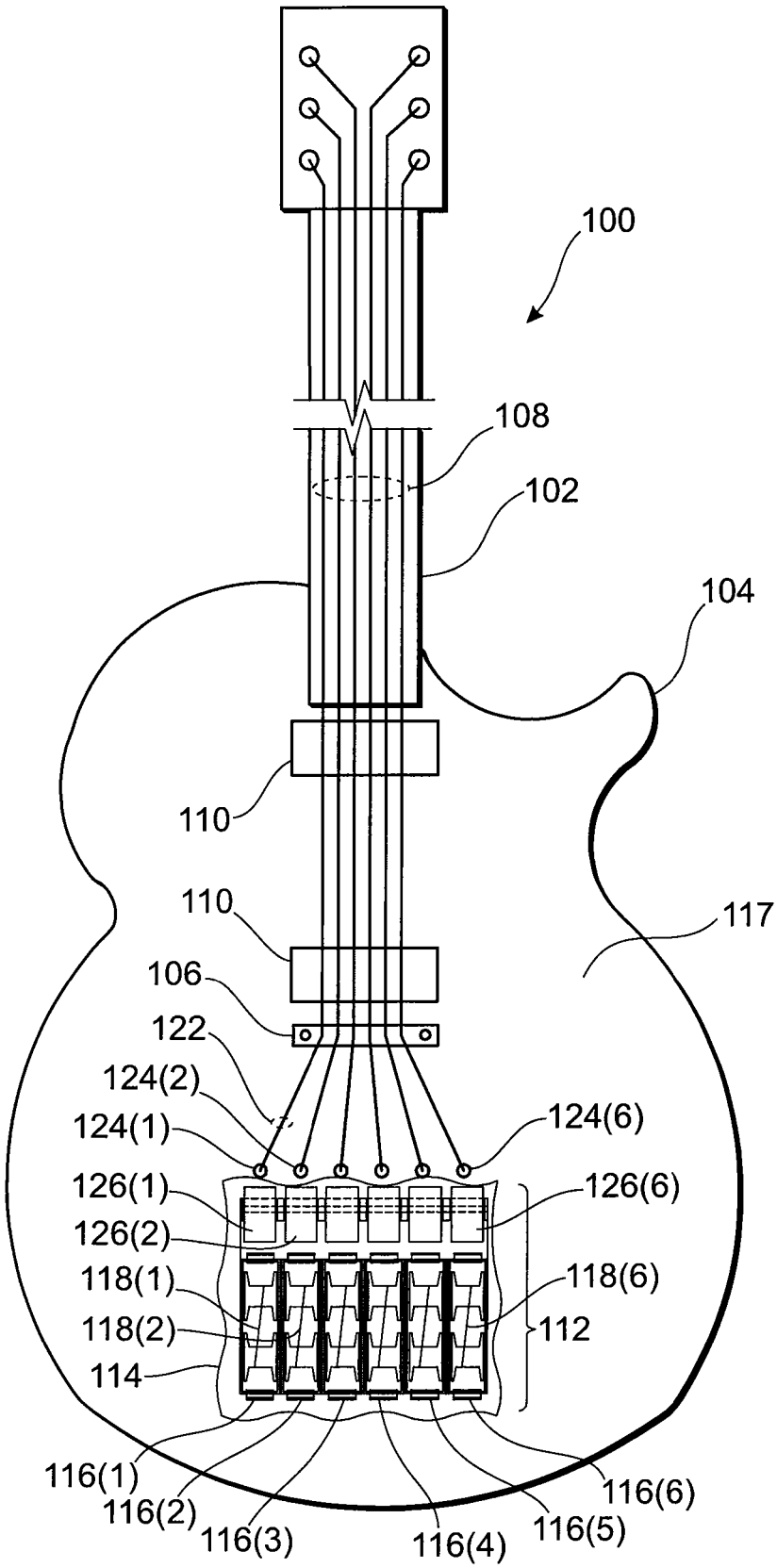
FIG. 1 is a top view of a guitar implemented in accordance with the principles of one embodiment of this invention.

Initially referring to FIG. 1, is a top view of a guitar 100 implemented in accordance with the principles of one embodiment of this invention. Guitar 100 includes typical elements usually found on most guitars, such as a neck 102, a body 104, a bridge 106, strings 108, and pickups 110. Unique to guitar 100, is a string-replacement assembly 112, a portion of which is visible in a cut-away view of guitar 100.

Most elements of string-replacement assembly 112 are located within an inner cavity 114 of body 104. String-replacement assembly 112 includes a plurality of cartridges 116(1), 116(2), . . . , 116(6), each configured to contain a supply of replacement string 118(1), 118(2), . . . , 118(6) respectively, therein. Each cartridge, referred to generally as reference number 116, contains a supply of replacement string, referred to generally as reference number 118, corresponding to a particular gauge of string installed on a topside 117 of guitar 100. In one embodiment, a cartridge may contain a sufficient supply of string to replace up to 10 full-length strings when installed in a playing position on topside 117. It is appreciated by those skilled in the art having the benefit of this disclosure that more or less lengths of supply string may be contained within a cartridge. For example, it may be advantageous to offer a supply of five-string lengths per cartridge as an option to reduce costs over a supply of ten-string lengths.

In the illustrated embodiment, there are six cartridges 116. In other embodiments, it is possible to have more or less cartridges depending on the number of strings deployed on the guitar or other musical instrument.

Each supply of replacement string 118 is rotatably mounted on spools (to be described) within each cartridge 116. A portion 122 of each supply of the replacement string 118 can be threaded through an exit opening 124 in body 104 of guitar 100 for installation on topside 117 of the guitar in a playing position. Although there are six exit openings 124(1), 124(2), . . . , 124(6), in the illustrated embodiment, it is appreciated by those skilled in the art having the benefit of this disclosure that more or less exit openings may be deployed in guitar 100. For example, in another embodiment, a single exit opening extending almost the width of bridge 106 may be deployed instead of six separate openings. An exit opening provides a passage way for passing/threading a string from inner cavity 114 to topside 117.

When a string mounted on topside 117 of the guitar is broken or requires replacement, a desired portion of the string may be removed, such as by cutting it. A remaining portion of the supply of replacement string 118 may be readily advanced from a corresponding cartridge 116 to a suitable length, and installed on the topside of the guitar to replace the removed portion of the string.

In one embodiment, optional locking devices 126(1), 126(2), . . . , 126(6) within inner cavity 114 of body 104 of guitar 100, are configured to anchor a portion of supply strings 122 in a fixed position when strings 108 are fastened in a playing position. Locking devices 126 prevent replacement string from advancing or moving backwards, once a portion of string 122 is installed on topside 117 of guitar 100 in a playing position. When it is desired to advance replacement string 118, the string may be disengaged from locking device 126 to permit the string to advance out of a cartridge 116. Alternatively, each locking device 126 may be configured to permit the string to readily pass through it, when in an unlocked mode, so as to readily advance replacement string 118 from inner cavity 114 of body 104 of guitar 100 to a suitable position for installation on topside 117 of guitar 100. Additionally, locking device 126 also permits a portion of strings 122 to be locked so that they can be easily tuned.

Although depicted as residing in inner cavity 114, locking device 126 may also be mounted on topside 117 of guitar, such as between bridge 106 and exit opening(s) 124.

In one embodiment locking device 126 is a cam-lock device, but as appreciated by those skilled in the art, after having the benefit of this disclosure, other types of locking devices may be deployed, such as a cleat system, locking pulley, or other suitable devices.

Figure 2:
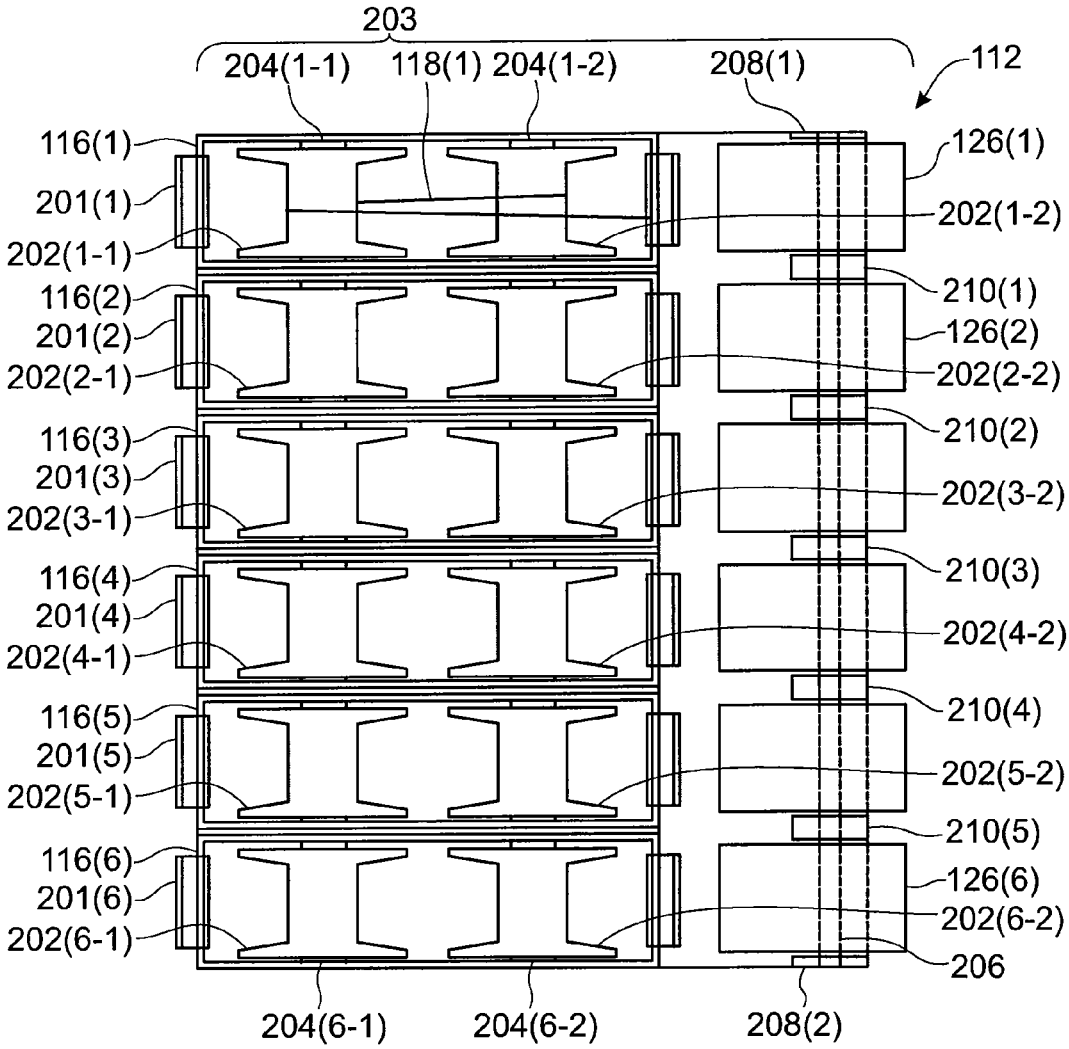
FIG. 2 shows a top view of one exemplary implementation for a string-replacement assembly.

FIG. 2 shows a top view of one exemplary implementation for string-replacement assembly 112. As depicted in FIG. 2, each cartridge 116 include a housing 201(1), 201(2), . . . , 201(6) that may be constructed of any suitable material that can withstand the rigors of being transported and used by musicians, e.g., plastic, aluminum, fiberglass, steel, wood, or any combination thereof. For example, in one embodiment each housing 201 is composed of a resilient plastic.

In one embodiment, housing 201 is pocket sized, being generally rectangular in shape and is approximately 2.75× 0.80 inches in width and length, and about 0.90 inches high. As appreciated by those skilled in the art, after having the benefit of this disclosure, housing 201 may be of other sizes, and shapes such as spherical, rectangular, or other configurations.

Each supply of replacement string, such as 118(1) (FIG. 2), is rotatably mounted within each cartridge 116. In one embodiment each cartridge 116 includes a spool system 203 for storing wound string. Each spool system may include two spools. For example, cartridge 116(1) includes spools 202(1-1) and 202(1-2). Each spool 202(1-1) and 202(1-2) is rotatable about a shaft 204(1-1), 204(1-2). Generally, the spools rotate in unison when string is wound or unwound there from. For example, spool 202(1-1) may rotate about shaft 204(1-1) in a first direction, while spool 202(1-2) may rotate about shaft 204(1-2) in a second direction opposite the first direction, such as when replacement string is unwound from each spool 202(1-1), and 202(1-2).

Each complementary pair of spools 202($n$−1) and 202($n$−2) per cartridge are spaced apart from each other at least a suitable-minimum distance to prevent memory loops from developing in the replacement strings when unwound from the spools. This suitable-minimum distance may vary depending on the nature of the replacement string (e.g., its material composition), thickness of each string, and dimensions of each spool 202. For instance, in one embodiment each pair complementary spools are approximately 1.25 inches apart, when measured from the center axis of each spool. As appreciated by those skilled in the art, after having the benefit of this disclosure, distances between spools may be greater or smaller, and may not be consistent.

Also depicted in FIG. 2 are locking devices 126(1), 126(2), . . . , 126(6). Locking devices 126 pivot around (i.e., rotate around) a shaft 206, which is mounted between inner walls 208(1), 208(2) of walls of inner cavity 114. Mounting blocks 210(1) . . . , 210(5) may be sandwiched between each locking device 126, providing support for both shaft 206 and locking devices 126. Mounting blocks 210 may be composed of any suitable rigid or semi-rigid materials, including, but not limited rubber, plastic, foam, composite materials, and so forth. Mounting blocks include inner cavities (see 410 in FIGS. 4 and 5) in which shaft 206 passes through.

Although depicted as single shaft 206, it is appreciated by those skilled in the art having the benefit of this disclosure, that shaft 206 may be segmented corresponding to each string 118. Each mounting block 210 as well as inner walls 208(1), 208(2) may have a cavity in which to receive and fasten a portion of each shaft.

Figure 3:
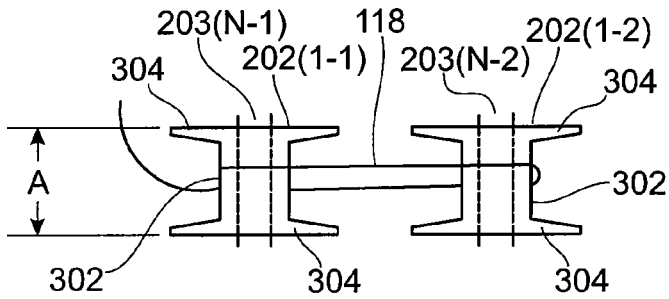
FIG. 3 shows a top view of exemplary spools in greater detail.

FIG. 3 shows a top view of exemplary spools 202(1-1) and 202(1-2) in greater detail. As depicted in the illustrative embodiment therein, each spool includes cylindrical surfaces 302, and a pair of flanges 304 extending radially outwardly on each side of cylindrical surfaces 302. Each cylindrical surface 302 generally has a receiving area large enough to accept replacement string 118 wrapped around portions thereof. For example, in embodiment each spool 202 is approximately one inch in diameter and approximately 0.5 inches in width (e.g. distance A). As appreciated by those skilled in the art, after having the benefit of this disclosure, other diameters larger or smaller may be utilized.

Figure 4:
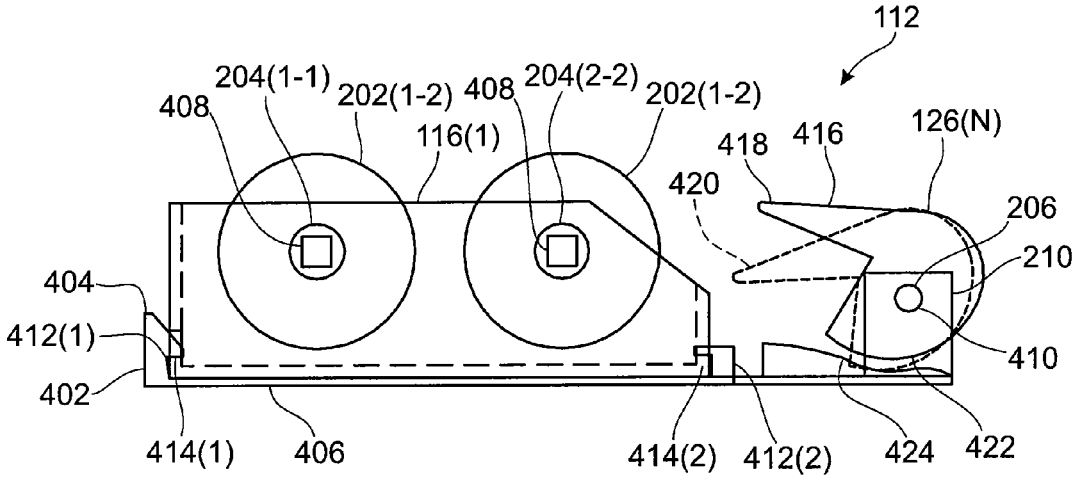
FIG. 4 shows a side view of a string-replacement assembly according to one implementation.

FIG. 4 shows a side view of string-replacement assembly 112 according to one implementation. As depicted therein, assembly 112 includes a plate 402. Plate 402 provides quick attachment platform to fasten or unfasten a cartridge (such as cartridge 116(1)). Opposing complementary spring members 404 and 406 from plate 402, and cartridge 116(1), respectively, are configured to permit cartridge 116 to snap into, and engage plate 402. Spring members 404 and 406 are calibrated to release platform cartridge 116(1) (such as when detaching cartridge 116(1) from platform 402) when pulling forces exceed a predetermined level. Cartridge 116(1) may be removed from plate 402 when string contained therein is exhausted. A refill cartridge, with a fully wound supply of string, may then be inserted into plate 402 to replace the empty/used cartridge. In one embodiment, spring members 404 include a male tab 412 for engaging a female recess 414 of cartridge 116.

As appreciated by those skilled in the art after having the benefit of this disclosure, that the spools themselves may replaced, independently as a unit (forming a "cartridge" unit) as opposed to a cartridge containing the spools. In such an implementation, it is possible for plate 402 to serve as a platform for attaching or detaching spools 202.

In one embodiment, shafts 204, may have a malleable material 408 disposed on an outer surface of each shaft 204. For example, in one embodiment, a foam material is disposed on an outer surface of each shaft 204. Malleable material 408 may help to prevent vibration, rattling and inadvertent unreeling of string 118.

It should be appreciated by those skilled in the art, with benefit of this disclosure, that other quick connect/disconnect systems may be used to install a cartridge 116 into plate 402 may consist of other connector technology, such as a push-pull connector system, a clip-style fastening system, or even a threaded screw system. Further, it is possible for cartridges 116 to be connected directly to an inner portion of body 104 of guitar 100.

Also depicted in FIG. 4 is locking device 126 is a cam-locking style device. Shaft 206 passes through an inner cavity (i.e. a hole) 410 located within locking devices 126 and mounting blocks 210. Locking device 126 includes a lever 416 that when depressed moves locking device 126 from a locked position 418 to an unlocked position 420. When in a locked position 418, a rounded-bottom portion 422 of locking device 126 depresses string 118 against an anvil 424 thereby holding string 118 in a fixed position. When in an unlocked position 418, rounded-bottom portion 422 moves away from anvil 424 thereby creating space for string 118 to move. Anvil 424 and rounded-bottom portion 422 are shaped so as not to minimize deforming (such as denting, kinking, flatten or damage) the shape of string 118. Anvil 424 and rounded-bottom portion 422 may also be composed of a malleable material so as to create friction while minimizing the chances of damaging string 118.

Figure 5:
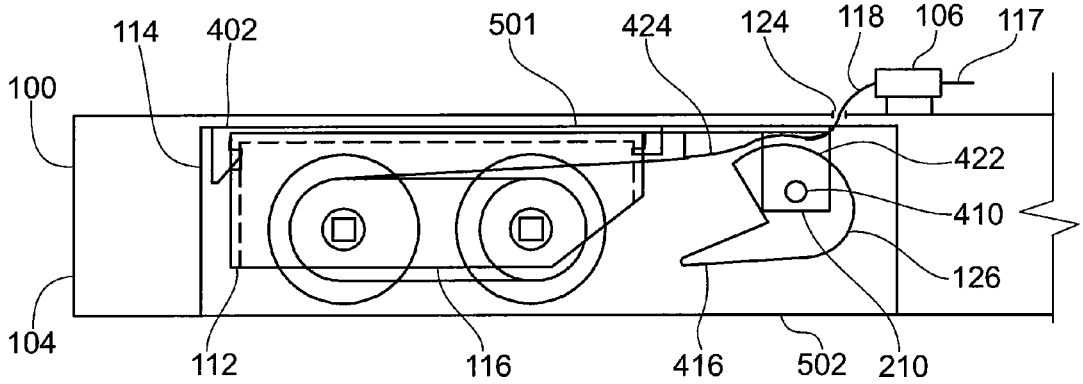
FIG. 5 shows a cross-sectional side view of a portion of a body of a guitar with a string-replacement assembly installed in an inner cavity therein.

FIG. 5 shows a cross-sectional side view of a portion of body 104 with string-replacement assembly 112 installed in an inner cavity 114 guitar 100. In this view platform 402 is anchored directly to an inner surface 501 of cavity 114. In one implementation, screws (not shown) are used to fasten platform 402 to inner surface 501. However, as appreciated by those skilled in the art other fastening means, such as but not limited to glue, rivets, nuts/bolts, etc., may be used attach platform 402 to body 104.

Also as depicted in FIG. 5, a back panel 502 permits access to inner cavity 114 for inserting or removing cartridges 116. This back panel 502 may be a hinged door, a sliding panel, or some other type of removably coupled access panel. Panel 502 and cavity 114 may be built into guitars retroactively, or be integrated into the design.

Also as shown in FIG. 5, a free end of each supply of the replacement string 118 can be threaded through exit opening 124 in body 104 of the guitar 100 for installation on topside 117 of the guitar 100 in a playing position. When a string mounted on topside 117 of guitar 100 is broken or requires replacement, a desired portion (e.g., a desired length) of string 118 may be removed, such as by cutting it. A remaining portion of supply of the replacement string 118 may be readily advanced from a corresponding cartridge 116 (e.g. spools 202) to a desired length, and installed on topside 117 of guitar 100 to replace the removed portion of the string.

String 118 may be color coded and include a warning color to alert a musician when a particular cartridge is running low of replacement string. An alarm/alert system (not shown) may also be used in conjunction with assembly 112 to monitor the quantity of string left in a cartridge, and provide a warning signal (such as blinking light-emitting diode) when it is determined that the supply of string 118 is almost empty. Back panel 502 may also be translucent, permitting a musician to readily view the quantity of string remaining in each cartridge.

As appreciated by those skilled in the art, after having the benefit of this disclosure, the supply of the replacement string 118 may be packaged inside inner cavity 114 in other suitable manners. For example, there be more than two spools per string. Additionally, other types of roller or pulley designs may be used to store the supply string in such a manner so as to prevent memory loops or crimps to occur in the strings.

The embodiments described herein are to be considered in all respects only as exemplary and not restrictive. The scope of the invention is, therefore, indicated by the subjoined Claims rather by the foregoing description. All changes which come within the meaning and range of equivalency of the Claims are to be embraced within their scope.

What is claimed is:

1. A string-replacement assembly for a guitar, comprising: a plurality of cartridges each configured to contain replacement string therein, wherein each cartridge contains a complementary pair of opposing spools that are freely rotatable, wherein the replacement string is wound around the complementary pair of opposing spools within a housing of each cartridge, and is adapted to be unwound to a selected length through an opening, when a string mounted in a playing position on the guitar is broken or is replaced, and wherein each housing is configured to be removably mounted within an inner cavity of a body of the guitar.

2. The string-replacement assembly as recited in claim 1, wherein the guitar contains a via configured to provide a passage way for the replacement string to unwind and extend from the inner cavity of a body of the guitar to a mounted position for playing on a topside of the guitar.

3. The string-storage assembly as recited in claim 1, further comprising means for fastening the housing within the inner cavity of the guitar.

4. A string-replacement assembly for musical instruments, comprising:

a plate configured to attach to an inner-portion of a body of the stringed-musical instrument;

a spool system, removably coupled to the plate, configured to store a first replacement string for installation on the stringed-musical instrument, wherein the first replacement string is at least a length sufficient to extend from a distal end of a neck of the musical instrument to a proximal end of a body portion of the musical instrument opposite the distal end, the spool system having:

(a) a first spool rotatable about a first shaft in a first direction, (b) a second spool rotatable about a second shaft in a second direction opposite the first direction, wherein the first and second spool are configured to rotate in unison when the first-replacement string is unwound from the first and second spools.

5. The string-replacement assembly as recited in claim 4, wherein the first spool and the second spool are spaced apart from each other at least a minimum distance such that when the first-replacement string is wound around or unwound from the first and second spools, memory loops do not develop in the replacement string.

6. The string-replacement assembly as recited in claim 4, wherein the first spool and the second spool have a radius large enough to prevent a memory loop from developing in the first-replacement string when the replacement string is wound around the first and second spools.

7. The string-replacement assembly as recited in claim 4, wherein at least one of the first shaft and second shaft, have a malleable material disposed on an outer surface of the shaft.

8. The string-replacement assembly as recited in claim 4, wherein at least one of the first shaft and second shaft, have a foam material disposed on an outer surface of the shaft.

9. The sting-replacement assembly as recited in claim 4, wherein the spool system further comprises: (c) a third spool rotatable about a third shaft in the first direction, (d) a fourth spool rotatable about a third shaft in the second direction opposite the first direction, wherein the third and fourth spool are configured to rotate in unison when a second-replacement string is unwound from the third and fourth spools.

10. The string-replacement assembly as recited in claim 4, further comprising a cam-lock device configured to anchor a portion of the first string to a point proximal to an outer portion of the body of the musical instrument.

11. The string-replacement assembly as recited in claim 4, wherein the first spool and the second spool comprise cylindrical surfaces with a receiving area arranged to accept a string long enough to accommodate at least a length of the musical instrument.

12. The string-replacement assembly as recited in claim 4, wherein the first spool and the second spool comprise cylindrical surfaces with a receiving area arranged to accept a string long enough to accommodate at least multiple lengths of the musical instrument.

13. The string-replacement assembly as recited in claim 4, wherein the first spool and the second spool comprise cylindrical surfaces with a receiving area to accept the first string wrapped around portions thereof, and a pair of flanges extending radially outwardly on each side of the cylindrical surfaces.

14. A guitar, comprising:

a string-replacement assembly having:

a plate configured to attach to an inner portion of a body of the guitar;

a spool system, removably coupled to the plate, configured to store a first replacement string for installation on the guitar, wherein the first replacement string is at least a length sufficient to extend from a distal end of a neck of the guitar to a proximal end of a body portion of the guitar opposite the distal end, the spool system having:

(a) a first spool rotatable about a first shaft in a first direction, (b) a second spool rotatable about a second shaft in a second direction opposite the first direction, wherein the first and second spool are configured to rotate in unison when the first-replacement string is unwound from the first and second spools.

15. The guitar as recited in claim 14, further comprising a via configured to provide a passage way for the first string from the inner portion of the body of the guitar to an outer portion the body of the guitar.

16. The guitar as recited in claim 14, further comprising a cam-lock device mounted a surface of an outer portion of the body of the guitar, the cam-lock device configured to anchor a portion of the first string to a point proximal to an outer portion of the body of the guitar.

17. The guitar as recited in claim 14, wherein the first spool and the second spool comprise cylindrical surfaces with a receiving area arranged to accept a string long enough to accommodate at least a length of the guitar.

18. The guitar as recited in claim 14, wherein the first spool and the second spool comprise cylindrical surfaces with a receiving area arranged to accept a string a long enough to accommodate multiple lengths of the guitar.

19. The guitar as recited in claim 14, further comprising an access panel, located on a back side of the body of the guitar opposite a front surface of the body of the guitar configured for playing.

* * * * *

UNITED STATES PATENT AND TRADEMARK OFFICE

CERTIFICATE OF CORRECTION

PATENT NO. : 7,790,971 B1
APPLICATION NO. : 12/493648
DATED : September 7, 2010
INVENTOR(S) : Michael Roman It is certified that error appears in the above-identified patent and that said Letters Patent is hereby corrected as shown below:

On the Title Page Item (73) should read,

--WomBom, LLC, Huntington Valley, PA (US)--.

Signed and Sealed this

Ninth Day of November, 2010

David J. Kappos

David J. Kappos
*Director of the United States Patent and Trademark Office*